United States Patent [19]

Phillips et al.

[11] 3,941,626

[45] Mar. 2, 1976

[54] ENERGETIC LIQUID MONOPROPELLANT COMPOSITIONS CONTAINING HYDRAZINE AND METHOXYLAMINE PERCHLORATE

[75] Inventors: John F. Phillips, Florence; James A. Murfree, Jr., Huntsville; Walter W. Wharton, Huntsville; William A. Duncan, Huntsville, all of Ala.

[73] Assignee: The United States of America as represented by the Secretary of the Army, Washington, D.C.

[22] Filed: June 24, 1970

[21] Appl. No.: 48,781

[52] U.S. Cl. ..... 149/36; 60/218

[51] Int. Cl.[2] ..... C06D 5/10

[58] Field of Search ..... 149/36; 60/218

[56] References Cited

UNITED STATES PATENTS

| | | | |
|---|---|---|---|
| 2,943,927 | 7/1960 | Audrieth et al. | 149/36 |
| 3,117,415 | 1/1964 | Greene | 149/36 X |
| 3,171,249 | 3/1965 | Bell | 149/36 X |
| 3,503,212 | 3/1970 | Jennings et al. | 60/219 |
| 3,623,327 | 11/1971 | Duncan et al. | 149/36 X |

*Primary Examiner*—Leland A. Sebastian
*Assistant Examiner*—E. A. Miller
*Attorney, Agent, or Firm*—Nathan Edelberg; Robert P. Gibson; James T. Deaton

[57] ABSTRACT

The use of methoxylamine perchlorate ($CH_3ONH_2.HClO_4$) as an additive to exothermally decomposing liquid monopropellants such as hydrazine and hydrazine water mixtures to maintain energetic monopropellants and at the same time lower the freezing point of the monopropellants, thereby rendering the monopropellants usable in gas generators at very low temperatures.

2 Claims, No Drawings

ENERGETIC LIQUID MONOPROPELLANT COMPOSITIONS CONTAINING HYDRAZINE AND METHOXYLAMINE PERCHLORATE

CROSS REFERENCE TO RELATED APPLICATION

This application is related to copending application Ser. No. 651,654 filed July 5, 1967 and now U.S. Pat. No. 3,757,520, and is an improvement over copending application Ser. No. 834,618 filed June 18, 1969.

BACKGROUND OF THE INVENTION

In the past, the use of monopropellants in gas generators has been limited due to the freezing points of the liquid monopropellants used. It is very desirable to have a liquid monopropellant composition that can be used in a gas generator at very low temperatures as well as at high temperatures. This would render the gas generator operable in practically any natural temperature environment.

Therefore, it is an object of this invention to provide novel liquid onopropellant compositions.

Another object of this invention is to provide liquid monopropellant compositions that have freezing points that extend to −54°C.

A further object of this invention is to provide a liquid monopropellant composition that has a low freezing point, yet the specific impulse of the liquid monopropellant is practically unchanged due to the freezing point depressants used in the liquid monopropellant.

SUMMARY OF THE INVENTION

It has been discovered that methoxylamine perchlorate ($CH_3ONH_2.HClO_4$) when used as an additive to hydrazine, to a hydrazine-water mixture or to other exothermally decomposing monopropellants produces a liquid monopropellant composition that has a freezing point which extends to at least −54°C. The liquid monopropellant composition produced has good exothermic decomposing properties when used in a catalytic bed type gas generator or in a chemi-thermo bed type gas generator of the type disclosed in copending application Ser. No. 651,654.

DESCRIPTION OF THE PREFERRED EMBODIMENTS

Concentrations of methoxylamine perchlorate in the amount of 42 weight percent lowers the freezing point of hydrazine from its normal value of +1°C. to −54°C. This freezing point is adequate for the intended use. The viscosity of a 20.5 weight percent solution at +21°C. is 1.6 centistokes, while at −35°C., it is 11.2 centistokes and is adequate for use in a gas generator.

Concentrations of methoxylamine perchlorate of about 20 weight percent, water of about 14 weight percent and hydrazine of 66 weight percent depress the freezing point of hydrazine from its normal value of +1°C. to a range of down to −55°C. This freezing point range is adequate for certain uses. The viscosity of this solution is adequate for gas generator use.

The methoxylamine perchlorate salt is used in hydrazine ($N_2H_4$), hydrazine-water mixtures and other propellant mixtures which without the addition of methoxylamine perchlorate would have a freezing point higher than the minimum required for the intended purpose. When water is used in the propellant mixtures, it is present in the amount of about 0 to 20 weight percent. The water acts as a freezing point depressant along with the methoxylamine perchlorate.

The concentration of methoxylamine perchlorate used in the solution will depend upon the freezing point range desired. The concentration of methoxylamine perchlorate may be about 1 to 50 weight percent with the preferred range for applicants' intended use in very cold environments being about 15 to 25 weight percent.

The methoxylamine perchlorate-hydrazine mixture is believed to be an unknown mixture of hydrazinium ($NH_2NH_3^+$), methoxyl ammonium ion ($CH_3ONH_3^+$) and perchlorate ion ($ClO_4^-$) along with the free bases, hydrazine and methoxylamine. Consequently, the mode of compounding the monopropellant is not critical. Thus, while the monopropellant mixtures tested were made by adding methoxylamine perchlorate to hydrazine, the same result may be obtained by adding perchloric acid to a hydrazine-methoxylamine mixture. If water is used, the hydrazine and water are combined before the methoxylamine perchlorate is added to the solution.

Because the specific impulse of methoxylamine is only slightly lower than hydrazine, no loss of impulse results when the perchlorate salt is used. The oxidizing power of the perchlorate ion as well as the increased density of the hydrazine-methoxylamine perchlorate solution should actually result in an increase in density impulse. Use of methoxylamine salts dissolved in hydrazine reduces delays in propellant ignition.

We claim:

1. A monopropellant composition of matter, for use in a liquid type gas generator, comprising a solution of hydrazine and methoxylamine perchlorate, said methoxylamine perchlorate being present in an amount of about 15 to about 25 weight percent and the remainder of said solution being hydrazine.

2. A monopropellant composition of matter, for use in a liquid type gas generator, comprising a solution of hydrazine, methoxylamine perchlorate and water, said methoxylamine perchlorate being present in an amount of about 20 weight percent, said water being present in an amount of about 14 weight percent and said hydrazine being present in an amount of about 66 weight percent.

* * * * *